US008653806B2

(12) United States Patent
Ide

(10) Patent No.: US 8,653,806 B2
(45) Date of Patent: Feb. 18, 2014

(54) BANDGAP REFERENCE CIRCUIT AND METHOD OF STARTING BANDGAP REFERENCE CIRCUIT

(71) Applicant: Elpida Memory, Inc., Tokyo (JP)

(72) Inventor: Akira Ide, Tokyo (JP)

( * ) Notice: Subject to any disclaimer, the term of this patent is extended or adjusted under 35 U.S.C. 154(b) by 0 days.

(21) Appl. No.: 13/628,819

(22) Filed: Sep. 27, 2012

(65) Prior Publication Data

US 2013/0021016 A1 Jan. 24, 2013

Related U.S. Application Data

(63) Continuation of application No. 12/547,156, filed on Aug. 25, 2009, now Pat. No. 8,294,449.

(30) Foreign Application Priority Data

Aug. 26, 2008 (JP) ..... 2008-216512

(51) Int. Cl.
*G05F 3/30* (2006.01)

(52) U.S. Cl.
USPC ..... 323/313; 323/316; 323/901

(58) Field of Classification Search
USPC ..... 323/313–317, 901; 327/539
See application file for complete search history.

(56) References Cited

U.S. PATENT DOCUMENTS

| | | | | |
|---|---|---|---|---|
| 4,857,823 | A | 8/1989 | Bitting | |
| 6,724,176 | B1 | 4/2004 | Wong et al. | |
| 7,148,672 | B1 | 12/2006 | Holmes | |
| 7,215,183 | B2 * | 5/2007 | Nakada | 327/539 |
| 7,626,374 | B2 | 12/2009 | Haiplik | |
| 7,688,054 | B2 * | 3/2010 | Cave | 323/313 |
| 2004/0257150 | A1 * | 12/2004 | Farooqui | 327/539 |
| 2008/0007244 | A1 | 1/2008 | Draxelmayr | |

OTHER PUBLICATIONS

Piero Malcovati, Curvature-compensated BiCMOS Bandgap with 1-V Supply Voltage, Jul. 2001, IEEE Journal of Solid-State Cicuits, vol. 36, No. 7, pp. 1076-1081.*

Banba et al., (2009). "A CMOS Bandgap Reference Circuit with Sub-1-V Operation," *IEEE Journal of Solid-State Circuits* 34(5): 670-673.

Ide, A., U.S. Office Action mailed Dec. 28, 2011, directed towards U.S. Appl. No. 12/547,156; 12 pages.

Ide, A., U.S. Office Action mailed May 17, 2012, directed towards U.S. Appl. No. 12/547,156; 10 pages.

* cited by examiner

*Primary Examiner* — Harry Behm

(57) ABSTRACT

In accordance with a bandgap circuit and a method of starting the bandgap circuit, a start signal is continuously supplied to a differential amplifier circuit to start up the differential amplifier circuit that controls a bandgap core circuit until the differential amplifier circuit has started up, and then the supply of the start signal to the differential amplifier circuit is discontinued after the differential amplifier circuit has started up.

12 Claims, 8 Drawing Sheets

BANDGAP REFERENCE CIRCUIT AND METHOD OF STARTING BANDGAP REFERENCE CIRCUIT

REFERENCE TO RELATED APPLICATIONS

This application is a continuation of U.S. patent application Ser. No. 12/547,156, filed Aug. 25, 2009, now allowed, which claims the priority of Japanese Patent Application No. 2008-216512, filed Aug. 26, 2008, the contents of which prior applications are incorporated herein by reference.

BACKGROUND OF THE INVENTION

1. Field of the Invention

The present invention generally relates to a bandgap reference circuit and a method of storing the bandgap reference circuit. More specifically, the present invention relates to a low power bandgap reference circuit which can be used for a variety of large scale integrated circuits, and a method of starting the low power bandgap reference circuit.

Priority is claimed on Japanese Patent Application No. 2008-216512, filed Aug. 26, 2008, the content of which is incorporated herein by reference.

2. Description of the Related Art

Bandgap reference circuits have been widely used for a variety of large scale integrated circuits because the bandgap reference circuits generates a reference voltage which is independent of temperature-dependency and of power-voltage-dependency. There have been a number of proposals for a low voltage bandgap reference circuit because the output voltage of the bandgap reference circuits may typically be, but is not limited to, about 1.2V. The output voltage of the bandgap reference circuits may often be similar to the power voltage of low voltage large scale integrated circuits.

A typical bandgap reference circuit is disclosed by H. Banba et al., "A CMOS Bandgap Reference Circuit with Sub-1-V Operation" in IEEE Journal of Solid-State Circuits, Vol. 34, No. 5, May 1999, pp. 670-673. The bandgap reference circuit is adjusted to generate an output reference voltage in the range of 0.6V to 0.72V which is suitable for the low voltage large scale integrated circuits which uses 1.2V of power voltage.

SUMMARY

In one embodiment, a bandgap circuit may include, but is not limited to, a bandgap core circuit, a differential amplifier circuit, and a start control circuit. The bandgap core circuit includes a first diode having a first junction area and a first forward voltage, a second diode having a second junction area larger than the first junction area and a second forward voltage, a first resistance connected in series to the second diode. The differential amplifier circuit controls first and second currents flowing through the first and second diodes respectively, so that the sum of the second forward voltage and a voltage drop of the first resistance approaches the first forward voltage. The start control circuit supplies a start signal to the differential amplifier circuit to start up the differential amplifier circuit, the start control circuit discontinuing the supply of the start signal to the differential amplifier circuit after the start control circuit has detected that the differential amplifier circuit has started up.

In another embodiment, a bandgap circuit may include, but is not limited to, a bandgap core circuit; a differential amplifier circuit controlling the bandgap core circuit; and a start control circuit that supplies a start signal to the differential amplifier circuit to start up the differential amplifier circuit. The start control circuit continues the supply of the start signal to the differential amplifier and the bandgap core circuit until the start control circuit has detected that the differential amplifier circuit has come operable.

In still another embodiment, a method of starting a band gap circuit may include, but is not limited to, continuously supplying a start signal to a differential amplifier circuit to start up the differential amplifier circuit that controls a bandgap core circuit until the differential amplifier circuit has started up, and discontinuing the supply of the start signal to the differential amplifier circuit after the differential amplifier circuit has started up.

BRIEF DESCRIPTION OF THE DRAWINGS

The above features and advantages of the present invention will be more apparent from the following description of certain preferred embodiments taken in conjunction with the accompanying drawings, in which.

DETAILED DESCRIPTION OF THE PREFERRED EMBODIMENTS

Figure 6:
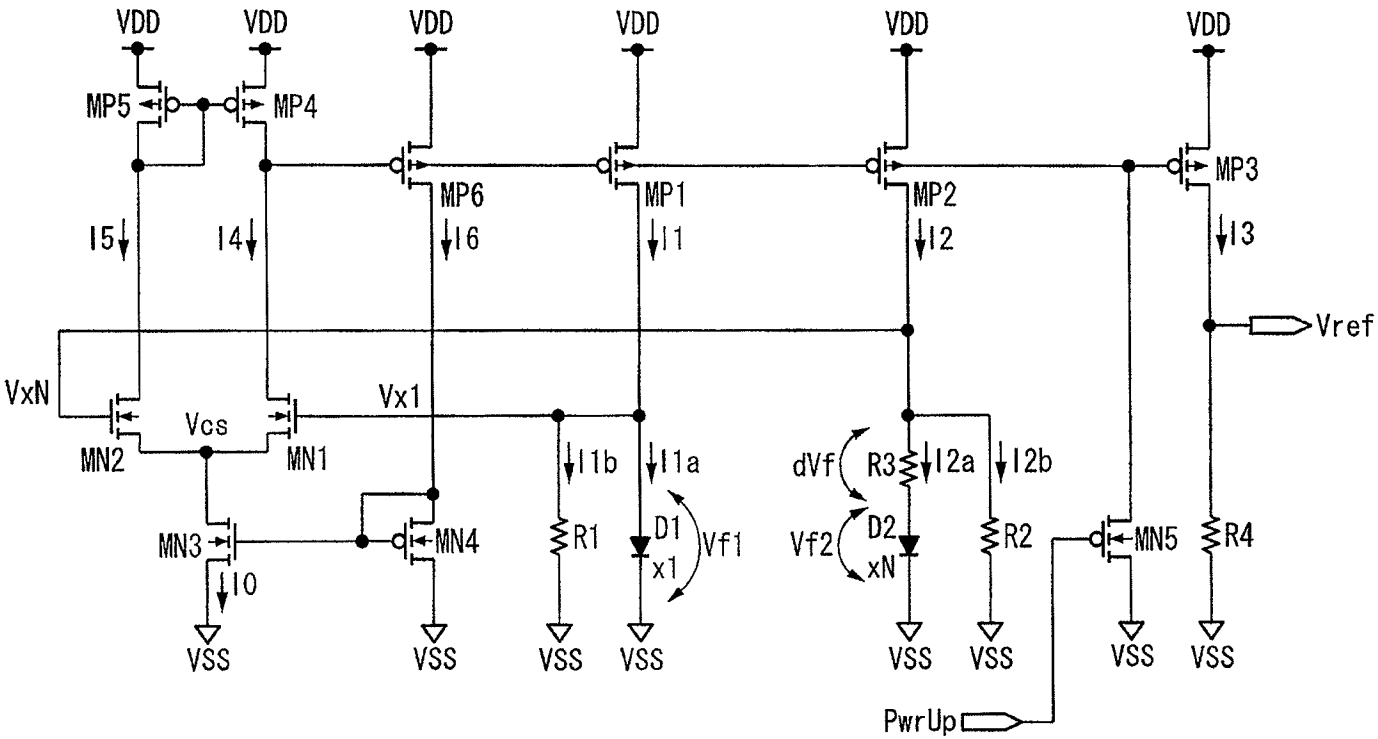
FIG. 6 Prior Art
FIG. 6 is a circuit diagram illustrating a low voltage bandgap reference circuit in the related art, which is disclosed in the above-mentioned paper.

Before describing the present invention, the related art will be explained in detail with reference to FIGS. 6, 7 and 8, in order to facilitate the understanding of the present invention. FIG. 6 is a circuit diagram illustrating a low voltage bandgap reference circuit in the related art, which is disclosed in the above-mentioned paper.

The operations of the low voltage bandgap reference circuit will hereinafter be described. A ratio in junction area of a diode D1 to a diode D2 is 1:N. For simplification, it is assumed that references R1 and R2 have the same resistance value, and p-channel MOS field effect transistors MP1, MP2 and MP3 have the same dimensions of gate width and gate length. A differential amplifier circuit is configured by n-channel MOS field effect transistors MN1, MN2, and MN3 and p-channel MOS field effect transistors MP4 and MP5.

The differential amplifier circuit adjusts currents I1, I2, and I3 so that the voltage Vx1 and the voltage VxN become identical to each other. Namely, the differential amplifier circuit adjusts the currents I1, I2, and I3 so that the currents I1, I2, and I3 become the same current value. This state is given by the following equation (1):

$$I1=I2=I3 \quad \text{Equation (1)}$$

Since Vx1=Vf1, Vx1=VxN, and R1=R2, the currents I1*b* and I2*b* that flow through the resistances R1 and R2 are given by the following equation (2):

$$I1b=I2b=Vf1/R1 \quad \text{Equation (2)}$$

The current I1*a* that flows through the diode D1 is given by the following equation (3):

$$I1a=Is\cdot A\cdot\exp\{Vf1/(kT/q)\} \quad \text{Equation (3)}$$

The current I2*a* that flows through the diode D2 is given by the following equation (4):

$$I2a=Is\cdot NA\cdot\exp\{Vf2/(kT/q)\} \quad \text{Equation (4)}$$

In Equations (3) and (4), "Is" represents the reverse saturation current to the junction per unit area, "A" represents the junction area of the diode D1. Since I1=I2 and I1*b*=I2*b*, then I1*a*=I2*a*. From Equations (3) and (4), the difference between Vf1 and Vf2 is given by the following equation (5):

$$Vf1-Vf2=(kT/q)\ln(N) \quad \text{Equation (5)}$$

Since Vx1=VxN, the difference between Vf1 and Vf2 given by Equation (5) is equal to a voltage dVf that is applied to a resistance R3. The voltage dVf is given by the following equation (6):

$$dVf=Vf1-Vf2=(kT/q)\ln(N) \quad \text{Equation (6)}$$

From Equation (6), the current I2*a* flowing through the resistance R3 is given by the following equation (7):

$$I1a=I2a=dVf/R3=(1/R3)(kT/q)\ln(N) \quad \text{Equation (7)}$$

Therefore, the current I3 is given by the following equation (8):

$$I3=I2=I2a+I2b=(1/R3)(kT/q)\ln(N)+Vf1/R1 \quad \text{Equation (8)}$$

From Equation (8), the output reference voltage of the bandgap reference circuit shown in FIG. 6 is given by the following equation (9):

$$Vref=R4I3=(R4/R1)\{Vf1+(R1/R3)(kT/q)\ln(N)\} \quad \text{Equation (9)}$$

In Equation (9), the terms in the brackets { }, namely "Vf1+(R1/R3) (kT/q) ln(N)" are the same as those of the normal bandgap reference circuit. The first term "Vf1" has the negative temperature coefficient. The second term "(kT/q)ln(N)" has the positive temperature coefficient. Thus, it is possible to cancel the positive and negative temperature coefficients together by adjusting "R1/R3". If the following condition is satisfied, the temperature coefficients become zero or approximately zero.

$$Vf1+(R1/R3)(kT/q)\ln(N)=1.2\text{V}$$

If the condition of "R4/R1=0.5-0.6" is satisfied, then Vref=0.6-0.72V. The bandgap reference circuit can be adjusted to generate the output reference voltage Vref in the range of 0.6V to 0.72V which is suitable for the low voltage large scale integrated circuits which uses 1.2V of power voltage.

Meanwhile, the bandgap reference circuit has not only the above-described operation state but also a stable state in which the currents are zero. In the stable state, a tail current I0 following through the transistor MN3 is zero, resulting in that all the currents I1, I2, I3, I4, I5 and I6 become zero. Thus, input voltages VxN and Vx1 of the differential amplifier circuit become nearly the ground potential. As a result, the output reference voltage Vref of the bandgap reference circuit becomes nearly zero. As described above, the output reference voltage Vref of the bandgap reference circuit is not raised even the high voltage as a power is necessary. The bandgap reference circuit is unable to rise the output reference voltage Vref by itself once the output reference voltage Vref of the bandgap reference circuit becomes nearly zero as described above. In order to countermeasure this issue, an external device is provided to detect that the power voltage is risen, and generate a power-up detection signal "PwrUp", so that the external device supplies the power-up detection signal "PwrUp" to a signal terminal "PwrUp" of the bandgap reference circuit of FIG. 6. The power-up detection signal "PwrUp" is supplied to the gate of the transistor MN5, so that the transistor MN5 turns ON and the lower voltage VSS is supplied to the gates of the transistors MP1, MP2, MP3 and MP6, thereby causing the drops of the gate potentials of the transistors MP1, MP2, MP3 and MP6. As a result, the transistors MP1, MP2, MP3 and MP6 turn ON so that the higher voltage VDD is supplied to the gates of the transistors MN1 and MN2. As a result, the gate voltages VxN and Vx1 of the transistors MN1 and MN2 are risen. Once the gate voltages VxN and Vx1 are risen enough to cause the tail currents, the differential amplifier circuit automatically generate the currents I1, I2, I3 and I6, thereby normally rising the output reference voltage Vref of the bandgap reference circuit.

Figure 7:
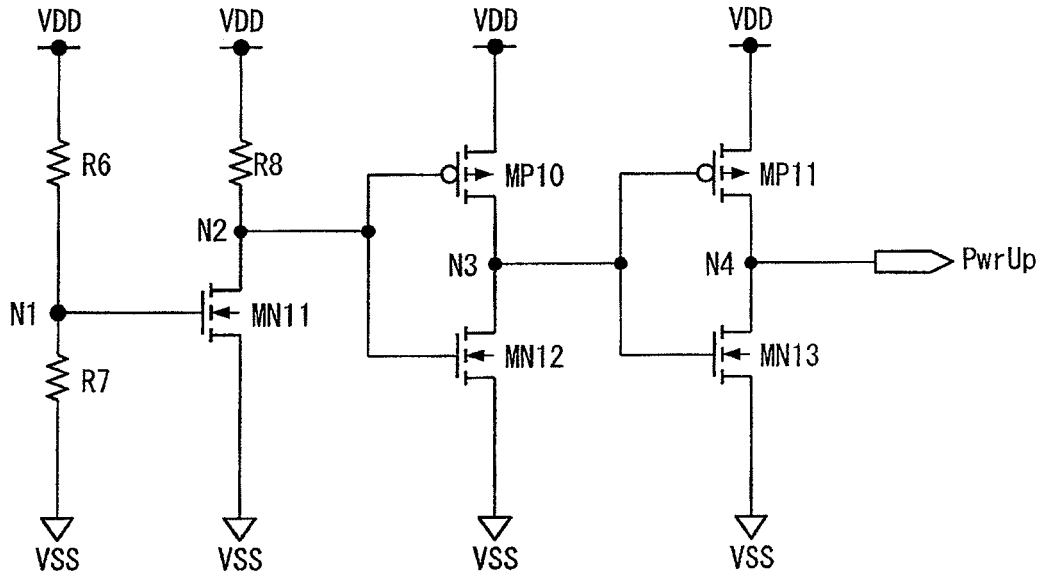
Prior Art FIG. 7
FIG. 7 is a circuit diagram illustrating a power voltage detection circuit is designed to detect that the power voltage is risen.

FIG. 7 is a circuit diagram illustrating a power voltage detection circuit is designed to detect that the power voltage is risen. The power voltage detection circuit generates the power-up detection signal "PwrUp". The power-up detection signal "PwrUp" is transitioned based on a result of comparison of the potential of a power voltage to a voltage VGS. The potential of a power voltage is given by dividing the voltage between the higher voltage VDD and the lower voltage VSS by resistances R6 and R7. The voltage VGS is a voltage that is to be applied to a gate electrode of an n-channel MOS transistor MN11. The voltage VGS is high enough to allow the n-channel MOS transistor MN11 to apply a sufficient current to a resistance R8. If the power voltage is low, then the power-up detection signal "PwrUp" is high. If the power voltage is high, then the power-up detection signal "PwrUp" is low. Transition of the power voltage from lower level to higher level causes transition of the power-up detection signal "PwrUp" from higher level to lower level.

Variation of the threshold voltage Vth of the n-channel MOS transistor MN11 and rising speed of the power voltage may, in some cases, cause that the power-up detection signal "PwrUp" is transitioned to the low level before the output reference voltage Vref is risen. FIG. 8 is a diagram illustrating simulated waveforms of output reference voltage Vref of the bandgap reference circuit of FIG. 6 and simulated waveforms of the power-up detection signal "PwrUp" of the power voltage detection circuit of FIG. 7.

Figure 8:
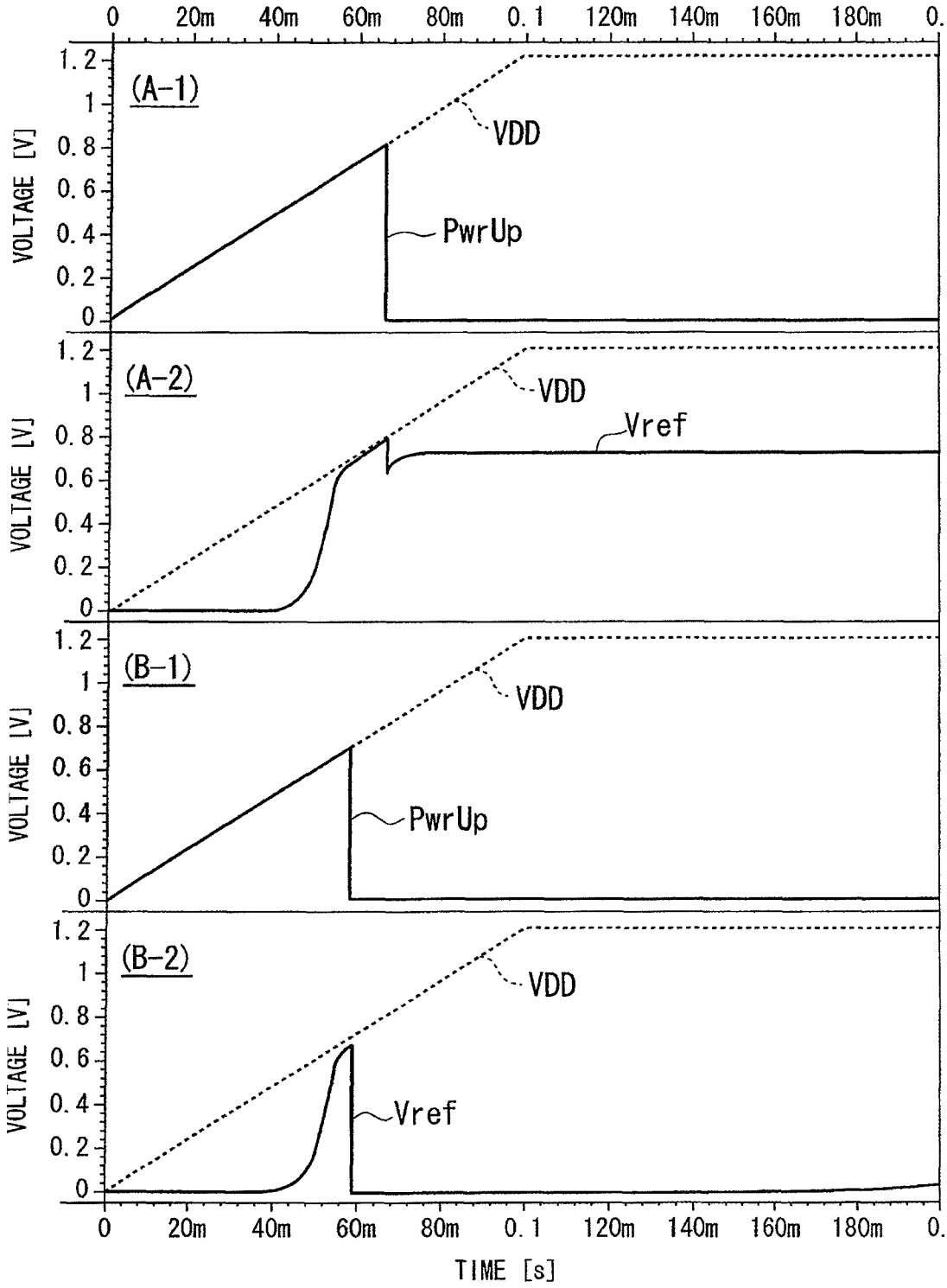
FIG. 8 is a diagram illustrating simulated waveforms of output reference voltage Vref of the bandgap reference circuit of FIG. 6 and simulated waveforms of the power-up detection signal "PwrUp" of the power voltage detection circuit of FIG. 7.

In FIG. 8, the waveforms marked with (A-1) and (A-2) represent the waveforms of the output reference voltage Vref and the power-up detection signal "PwrUp" when the high voltage VDD is risen from 0V to 1.2V in the initial time period of 100 ms and the transition voltage of the power-up detection signal "PwrUp" is 0.8V. The power-up detection signal "PwrUp" is transitioned to the low level from the transition voltage of 0.8V. In response to the transition of the power-up detection signal "PwrUp", the output reference voltage Vref is drop slightly, and then is kept at about 0.7V.

In FIG. 8, the waveforms marked with (B-1) and (B-2) represent the waveforms of the output reference voltage Vref and the power-up detection signal "PwrUp" when the high voltage VDD is risen from 0V to 1.2V in the initial time period of 100 ms and the transition voltage of the power-up detection signal "PwrUp" is 0.7V. The power-up detection signal "PwrUp" is transitioned to the low level from the transition voltage of 0.7V. In response to the transition of the power-up detection signal "PwrUp", the output reference voltage Vref is drop largely to approximately zero, and kept at approximately zero.

It is preferable that the bandgap reference circuit is free from the phenomenon that the bandgap reference circuit becomes unable to rise the output reference voltage Vref. The above-described power voltage detection circuit is unable to detect the voltage rising of the differential amplifier of the bandgap reference circuit and allows the transition of the power-up detection signal "PwrUp". This may cause that the output reference voltage Vref is not risen. For starting the bandgap reference circuit, no observation is made on whether the differential amplifier circuit of the bandgap reference circuit is placed in operating state or non-operating state in which the current is zero as long as the power voltage detection signal is supplied to the bandgap reference circuit from an external circuit.

The invention will be now described herein with reference to illustrative embodiments. Those skilled in the art will recognize that many alternative embodiments can be accomplished using the teaching of the present invention and that the invention is not limited to the embodiments illustrated for explanatory purpose.

For starting the bandgap reference circuit, a starting signal is supplied to the differential amplifier circuit so that the differential amplifier circuit is started up. After it is detected that the output voltage from the differential amplifier circuit is risen, then the starting signal that is supplied to the differential amplifier circuit turns OFF. For starting the bandgap reference circuit, the differential amplifier circuit is forcibly operated to rise the output voltage from the differential amplifier circuit. After the output voltage from the differential amplifier circuit has been completely risen up, then the starting signal to the differential amplifier circuit turns OFF. This allows that after the output reference voltage of the bandgap reference circuit has been completely risen, then the starting signal to the differential amplifier circuit turns OFF. This allows that the bandgap reference circuit is free from the phenomenon that the bandgap reference circuit becomes unable to rise the output reference voltage.

First Embodiment

Figure 1:
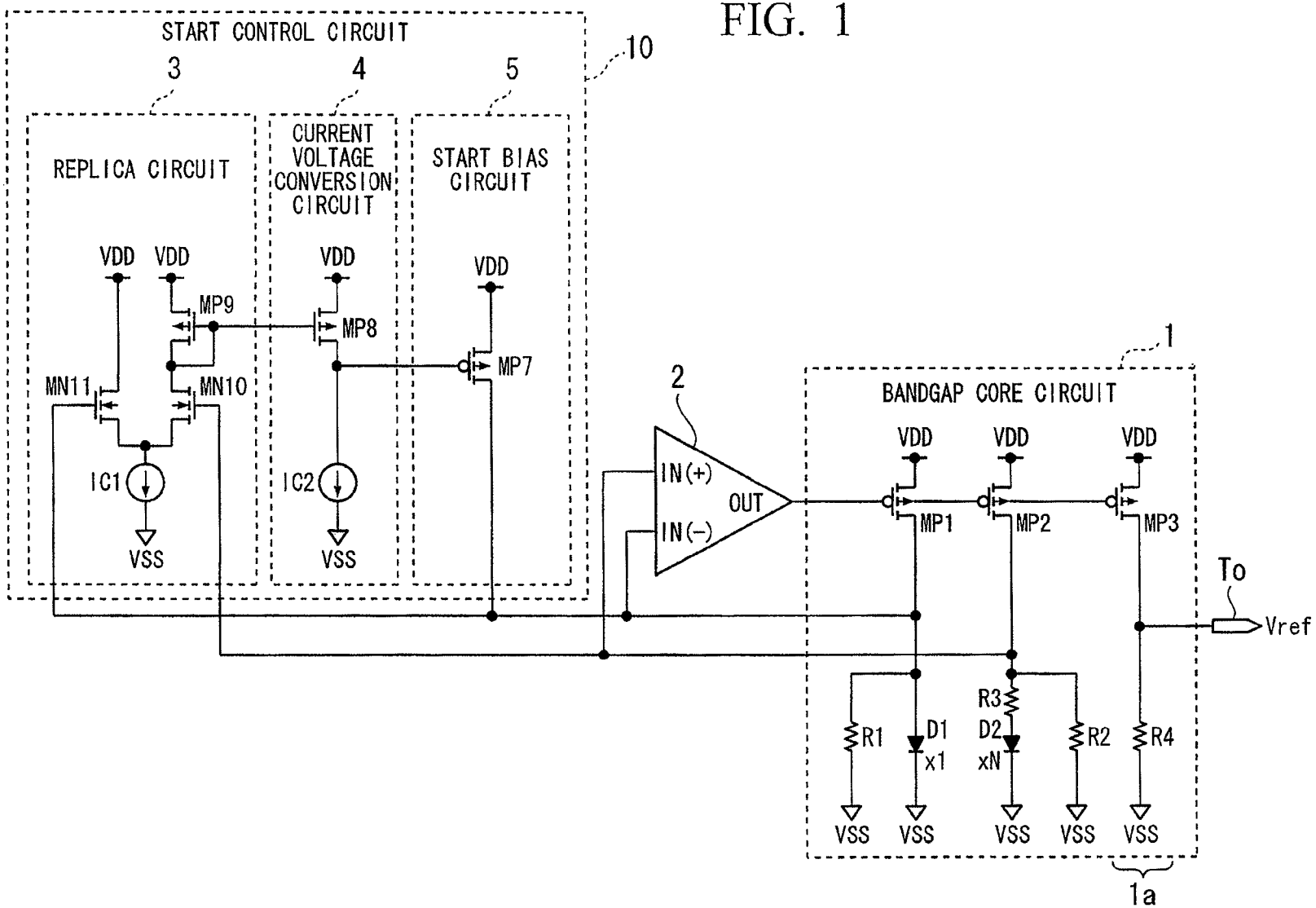
FIG. 1 is a circuit diagram illustrating a bandgap reference circuit in accordance with a first embodiment of the present invention.

FIG. 1 is a circuit diagram illustrating a bandgap reference circuit in accordance with a first embodiment of the present invention. A bandgap reference circuit may include, but is not limited to, a bandgap core circuit 1, a differential amplifier circuit 2, and a start control circuit 10. The differential amplifier circuit 2 may be electrically coupled to the bandgap core circuit 1. The differential amplifier circuit 2 has an output OUT that may be connected to the bandgap core circuit 1. The differential amplifier circuit 2 has positive and negative inputs IN(+) and IN(−) which are may be connected to the bandgap core circuit 1. The start control circuit 10 may be electrically coupled to the bandgap core circuit 1. The start control circuit 10 may be electrically coupled to the differential amplifier circuit 2. The start control circuit 10 may be connected to the positive and negative inputs IN(+) and IN(−) of the differential amplifier circuit 2. The start control circuit 10 may include, but is not limited to, a replica circuit 3, a current voltage conversion circuit 4, and a start bias circuit 5. The replica circuit 3 may be electrically coupled to the current voltage conversion circuit 4. The current voltage conversion circuit 4 may be electrically coupled to the start bias circuit 5. The replica circuit 3 may be electrically connected to the positive and negative inputs IN(+) and IN(−) of the differential amplifier circuit 2. The replica circuit 3 may be electrically coupled to the bandgap core circuit 1. The start bias circuit 5 may be electrically connected to the positive input IN(+) of the differential amplifier circuit 2. The start bias circuit 5 may be electrically connected to the bandgap core circuit 1. The bandgap core circuit 1 has an output terminal "To" at which an output reference voltage Vref appears.

The bandgap core circuit 1 may include, but is not limited to, first and second diodes D1 and D2 which have different junction areas, resistances R1, R2, R3 and R4, and p-channel MOS transistors MP1, MP2 and MP3. The bandgap core circuit 1 has an output section 1*a*.

The first and second diodes D1 and D2 have different junction areas. The first diode D1 is smaller in junction area than the second diode D2. The first diode D1 has a cathode which is connected to a lower voltage VSS. The lower voltage VSS may typically be, but is not limited to, the ground potential VSS. The first diode D1 has an anode which is connected to a drain of the p-channel MOS transistor MP1. The p-channel MOS transistor MP1 has a source which is connected to a power supply VDD which is higher in voltage than the lower voltage VSS, for example, the ground potential VSS. The resistance R1 is connected between the lower voltage VSS such as the ground potential VSS and the drain of the p-channel MOS transistor MP1, wherein the resistance R1 is parallel to the first diode D1.

The second diode D2 has a cathode which is connected to the lower voltage VSS such as the ground potential VSS. The second diode D2 has an anode which is connected through the resistance R3 to a drain of the p-channel MOS transistor MP2. The p-channel MOS transistor MP2 has a source which is connected to the power supply VDD. The resistance R2 is connected between the lower voltage VSS such as the ground potential VSS and the drain of the p-channel MOS transistor MP2, wherein the resistance R2 is parallel to the series connection circuit of the second diode D2 and the resistance R3. The output section 1*a* may include, but is not limited to, a series connection circuit of the resistance R4 and the p-channel MOS transistor MP3. The resistance R4 is connected between the lower voltage VSS such as the ground potential VSS and a drain of the p-channel MOS transistor MP3. The p-channel MOS transistor MP3 has a source which is connected to the power supply VDD.

The p-channel MOS transistor MP1 has a gate which is connected to the output OUT of the differential amplifier circuit 2. The p-channel MOS transistor MP2 has a gate which is connected to the output OUT of the differential amplifier circuit 2. The p-channel MOS transistor MP3 has a gate which is connected to the output OUT of the differential amplifier circuit 2.

The anode of the first diode D1 is connected to the negative input IN(−) of the differential amplifier circuit 2. The connection point between the resistance R3 and the drain of the p-channel MOS transistor MP2 is connected to the positive input IN(+) of the differential amplifier circuit 2. The connection point between the resistance R4 and the drain of the p-channel MOS transistor MP3 is connected to the output terminal "To".

The differential amplifier circuit 2 has a function to control first and second currents which flow through the first and second diodes D1 and D2, so that the sum of the forward voltage of the second diode D2 with the larger junction area and the voltage drop of the resistance R3 is equal to the forward voltage of the first diode D1 with the smaller junction area.

The start control circuit 10 prevents the phenomenon that the bandgap core circuit 1 combined with the differential amplifier circuit 2 becomes unable to rise the output reference voltage Vref. The start control circuit 10 includes the replica circuit 3, the current voltage conversion circuit 4, and the start bias circuit 5. The replica circuit 3 is a replica of the input differential pair of the differential amplifier circuit 2. The current voltage conversion circuit 4 detects the currents flowing through the differential pair of the differential amplifier circuit 2. The start bias circuit 5 causes a current to flow through the first diode D1 with the smaller junction area, based on the output from the current voltage conversion circuit 4. The start bias circuit 5 generates a start signal SC as an output. The start bias circuit 5 supplies the start signal SC to the differential amplifier circuit 2 and to the bandgap core circuit 1.

The replica circuit 3 forms a differential amplifier circuit. The replica circuit 3 includes the differential pair which is formed by a pair of n-channel transistors MN10 and MN11. The replica circuit 3 includes a p-channel transistor MP9. The differential-paired n-channel transistors MN10 and MN11 have sources which are commonly connected through a constant current source IC1 to the lower voltage VSS such as the ground potential VSS. The n-channel transistor MN11 has a drain that is connected to the power supply VDD. The n-channel transistor MN10 has a drain that is connected to a drain of the p-channel transistor MP9. The drain of the n-channel transistor MN10 is also connected to a gate of the p-channel transistor MP9. The p-channel transistor MP9 has a source that is connected to the power supply VDD. The n-channel transistor MN11 has a gate that is connected to the anode of the first diode D1 in the bandgap core circuit 1. The n-channel transistor MN10 has a gate that is connected to the connecting point between the resistance R3 and the p-channel transistor MP2 in the bandgap core circuit 1.

The current voltage conversion circuit 4 may include, but is not limited to, a p-channel transistor MP8 and a constant current source IC2. The p-channel transistor MP8 has a gate that is connected to the gate of the p-channel transistor MP9 in the replica circuit 3. The p-channel transistor MP8 has a source that is connected to the power supply VDD. The p-channel transistor MP8 has a drain that is connected through the constant current source IC2 to the lower voltage VSS such as the ground potential VSS. The constant current source IC2 is connected between the drain of the p-channel transistor MP8 and the lower voltage VSS such as the ground potential VSS.

The start bias circuit 5 may include, but is not limited to, a p-channel transistor MP7. The p-channel transistor MP7 has a source that is connected to the power supply VDD. The p-channel transistor MP7 has a gate that is connected to the drain of the p-channel transistor MP8 in the current voltage conversion circuit 4. The p-channel transistor MP7 has a drain that is connected to the anode of the first diode D1 in the bandgap core circuit 1. The p-channel transistor MP7 supplies a drain current that serves as a start signal SC to the first diode D1 in the bandgap core circuit 1 and also to the gate of the negative input IN(−) of the differential amplifier circuit 2.

The replica circuit 3 replicates the tail current of the differential amplifier circuit 2. If no tail current is flown, the output of the current voltage conversion circuit 4 is transitioned to the low level. The low level as the output of the current voltage conversion circuit 4 is supplied to the gate of the p-channel transistor MP7 in the start bias circuit 5. As a result, the p-channel transistor MP7 turns ON, so that the p-channel transistor MP7 supplies the start signal SC to the first diode D1 with the smaller junction area in the bandgap core circuit 1 as well to the negative input IN(−) of the differential amplifier circuit 2. Since the drain of the p-channel transistor MP7 is connected to the negative input IN(−) of the differential amplifier circuit 2, the start signal SC increases the potential of the negative input IN(−) of the differential amplifier circuit 2. The increased potential of the negative input IN(−) causes the tail current of the differential amplifier circuit 2, whereby the differential amplifier circuit 2 comes into the operable state.

Since the negative input IN(−) of the differential amplifier circuit 2 has higher potential, the output OUT of the differential amplifier circuit 2 is driven to the lower level. The low level output OUT of the differential amplifier circuit 2 is supplied to the gates of the p-channel transistors MP1, MP2, and MP3, so that the p-channel transistors MP1, MP2, and MP3 turn ON. As a result, the current flows through the series circuit of the resistance R3 and the second diode D2 with the larger junction area. The positive input IN(+) of the differential amplifier circuit 2 is also increased because the connecting point between the p-channel transistor MP2 and the series circuit of the resistance R3 and the second diode D2 is connected to the positive input IN(+) of the differential amplifier circuit 2. The connection point between the p-channel transistor MP1 and the first diode D1 with the smaller junction area is connected to the gate of the n-channel transistor MN11 in the replica circuit 3. The connection point between the p-channel transistor MP2 and the series circuit of the resistance R3 and the second diode D2 with the larger junction area is connected to the gate of the n-channel MN10 in the replica circuit 3. Thus, the potentials of the inputs of the replica circuit 3, namely the gate potentials of the n-channel transistors MN10 and MN11 are increased. The gate of the n-channel transistor MN10 in the replica circuit 3 is connected to the positive input IN(+) of the differential amplifier circuit 2. If the predetermined amount of the current flows through the n-channel transistor MN10, then the output of the current voltage conversion circuit 4 is transitioned to the high level. Since the high level output of the current voltage conversion circuit 4 is supplied to the gate of the p-channel transistor MP7 in the start bias circuit 5, the p-channel transistor MP7 turns OFF, so that the start bias circuit 5 stops supplying the start signal SC or the drain current to the first diode D1 with the smaller junction area and to the negative input IN(−) of the differential amplifier circuit 2. The differential amplifier circuit 2 itself is able to stop the start bias circuit 5 from supplying the start signal SC or the drain current to the first diode D1 with the smaller junction area and to the negative input IN(−) of the differential amplifier circuit 2. It is impossible to stop the start bias circuit 5 from supplying the start signal SC or the drain current to the first diode D1 with the smaller junction area and to the negative input IN(−) of the differential amplifier circuit 2 unless the differential amplifier circuit 2 is operable. The bandgap reference circuit of FIG. 1 does not need any external start signal. The above-described circuit configuration ensures that the bandgap core circuit 1 be stably started up by the start control circuit 10.

Second Embodiment

Figure 2:
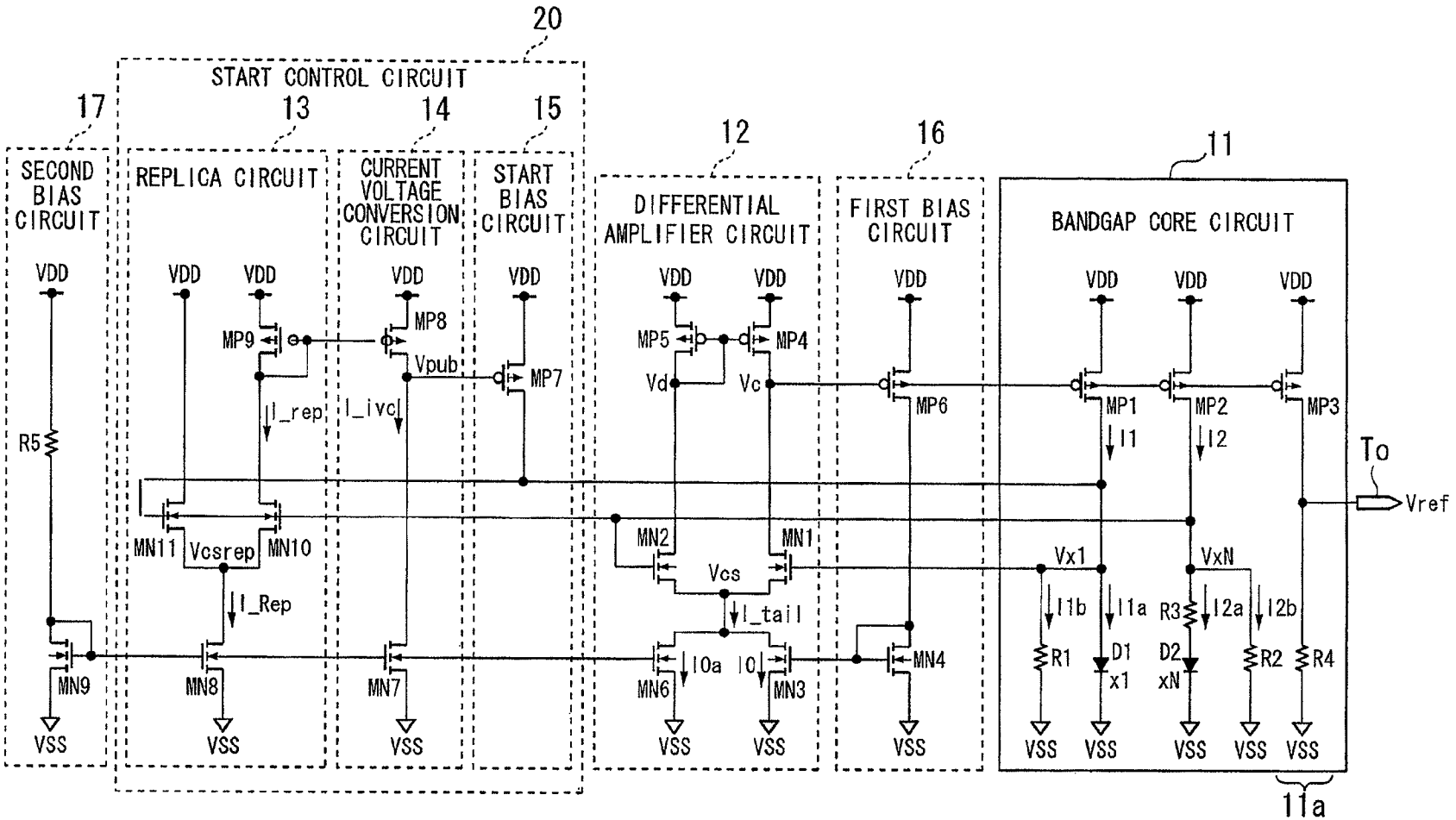
FIG. 2 is a circuit diagram illustrating a bandgap reference circuit in accordance with a second embodiment of the present invention.

FIG. 2 is a circuit diagram illustrating a bandgap reference circuit in accordance with a second embodiment of the present invention. A bandgap reference circuit of FIG. 2 may include, but is not limited to, a bandgap core circuit 11, a differential amplifier circuit 12, a start control circuit 20, a first bias circuit 16, and a second bias circuit 17. The differential amplifier circuit 12 may be electrically coupled to the bandgap core circuit 11. The differential amplifier circuit 12 may also be electrically coupled to the first bias circuit 16. The differential amplifier circuit 12 has an output OUT that may be connected to the bandgap core circuit 11 and also connected to the first bias circuit 16. The differential amplifier circuit 12 has positive and negative inputs IN(+) and IN(−) which are may be connected to the bandgap core circuit 11. The start control circuit 20 may be electrically coupled to the bandgap core circuit 11. The start control circuit 20 may be electrically coupled to the differential amplifier circuit 12. The start control circuit 20 may be connected to the positive and negative inputs IN(+) and IN(−) of the differential amplifier circuit 12. The start control circuit 20 may include, but is not limited to, a replica circuit 13, a current voltage conversion circuit 14, and a start bias circuit 15. The replica circuit 13 may be electrically coupled to the current voltage conversion circuit 14. The current voltage conversion circuit 14 may be electrically coupled to the start bias circuit 15. The replica circuit 13 may be electrically connected to the positive and negative inputs IN(+) and IN(−) of the differential amplifier circuit 12. The replica circuit 13 may be electrically coupled to the bandgap core circuit 11. The start bias circuit 15 may be electrically connected to the positive input IN(+) of the differential amplifier circuit 2. The start bias circuit 15 may be electrically connected to the bandgap core circuit 11. The bandgap core circuit 11 has an output terminal "To" at which an output reference voltage Vref appears.

The bandgap core circuit 11 may include, but is not limited to, first and second diodes D1 and D2 which have different junction areas, resistances R1, R2, R3 and R4, and p-channel MOS transistors MP1, MP2 and MP3. The bandgap core circuit 11 has an output section 11*a*.

The first and second diodes D1 and D2 have different junction areas. The first diode D1 is smaller in junction area than the second diode D2. The first diode D1 has a cathode which is connected to a lower voltage VSS. The lower voltage VSS may typically be, but is not limited to, the ground potential VSS. The first diode D1 has an anode which is connected to a drain of the p-channel MOS transistor MP1. The p-channel MOS transistor MP1 has a source which is connected to a power supply VDD which is higher in voltage than the lower voltage VSS, for example, the ground potential VSS. The resistance R1 is connected between the lower voltage VSS such as the ground potential VSS and the drain of the p-channel MOS transistor MP1, wherein the resistance R1 is parallel to the first diode D1.

The second diode D2 has a cathode which is connected to the lower voltage VSS such as the ground potential VSS. The second diode D2 has an anode which is connected through the resistance R3 to a drain of the p-channel MOS transistor MP2. The p-channel MOS transistor MP2 has a source which is connected to the power supply VDD. The resistance R2 is connected between the lower voltage VSS such as the ground potential VSS and the drain of the p-channel MOS transistor MP2, wherein the resistance R2 is parallel to the series connection circuit of the second diode D2 and the resistance R3. The output section 11*a* may include, but is not limited to, a series connection circuit of the resistance R4 and the p-channel MOS transistor MP3. The resistance R4 is connected between the lower voltage VSS such as the ground potential VSS and a drain of the p-channel MOS transistor MP3. The p-channel MOS transistor MP3 has a source which is connected to the power supply VDD.

The p-channel MOS transistor MP1 has a gate which is connected to the output Vc of the differential amplifier circuit 12. The p-channel MOS transistor MP2 has a gate which is connected to the output Vc of the differential amplifier circuit 12. The p-channel MOS transistor MP3 has a gate which is connected to the output Vc of the differential amplifier circuit 12.

The anode of the first diode D1 is connected to the negative input IN(−) of the differential amplifier circuit 12. The connection point between the resistance R3 and the drain of the p-channel MOS transistor MP2 is connected to the positive input IN(+) of the differential amplifier circuit 12. The connection point between the resistance R4 and the drain of the p-channel MOS transistor MP3 is connected to the output terminal "To".

The differential amplifier circuit 12 may include, but is not limited to, p-channel transistors MP4 and MP5, and n-channel transistors MN1, MN2, MN3, and MN6. The p-channel transistor MP4 has a source that is connected to the power supply VDD. The p-channel transistor MP4 has a drain that is connected to gates of the p-channel MOS transistors MP1, MP2, and MP3. The p-channel transistor MP4 has a gate that is connected to a gate and a drain of the p-channel transistor MP5. The p-channel transistor MP5 has a source that is connected to the power supply VDD. The p-channel transistor MP5 has a drain that is connected to the gate of the p-channel transistor MP4. The n-channel transistor MN1 has a drain that is connected to the drain of the p-channel transistor MP4. The n-channel transistor MN1 has a gate that is connected to the drain of the p-channel MOS transistor MP1 in the bandgap core circuit 11. The gate of the n-channel transistor MN1 is also connected to the anode of the first diode D1. The gate of the n-channel transistor MN1 is also connected to the resistance R1. The n-channel transistor MN1 has a source that is connected to a source of the n-channel transistor MN2. The n-channel transistor MN2 has the source that is connected to the source of the n-channel transistor MN1. The n-channel transistor MN2 has a drain that is connected to the drain and the gate of the p-channel MOS transistor MP5, and also connected to the gate of the p-channel MOS transistor MP4. The n-channel transistor MN2 has a gate that is connected to the drain of the p-channel transistor MP2 in the bandgap core circuit 11. The gate of the n-channel transistor MN2 is also connected to the series circuit of the resistance R3 and the second diode D2 with the larger junction area. The gate of the n-channel transistor MN2 is also connected to the resistance R2. The gate of the n-channel transistor MN1 serves as the negative input IN(−) of the differential amplifier circuit 2. The gate of the n-channel transistor MN2 serves as the positive input IN(+) of the differential amplifier circuit 12. The n-channel transistor MN3 has a source that is connected to the lower voltage VSS such as the ground potential VSS. The n-channel transistor MN3 has a drain that is connected to the sources of the n-channel transistors MN1 and MN2. The n-channel transistor MN6 has a source that is connected to the lower voltage VSS such as the ground potential VSS. The n-channel transistor MN6 has a drain that is connected to the sources of the n-channel transistors MN1 and MN2.

The first bias circuit 16 may include, but is not limited to, a p-channel transistor MP6 and an n-channel transistor MN4. The p-channel transistor MP6 has a source that is connected to the power supply VDD. The p-channel transistor MP6 has a gate that is connected to the drain of the p-channel transistor MP4 in the differential amplifier circuit 12. The gate of the p-channel transistor MP6 is also connected to the gates of the p-channel transistors MP1, MP2 and MP3 in the bandgap core circuit 11. The p-channel transistor MP6 has a drain that is connected to a drain and a gate of the n-channel transistor MN4. The n-channel transistor MN4 has a source that is connected to the lower voltage VSS such as the ground potential VSS. The n-channel transistor MN4 has a gate that is connected to the gate of the n-channel transistor MN3 in the differential amplifier circuit 12. The gate of the n-channel transistor MN4 is also connected to the drain of the p-channel transistor MP6.

The start control circuit 20 includes the replica circuit 13, the current voltage conversion circuit 14, and the start bias circuit 15. The replica circuit 13 is a replica of the input differential pair of the differential amplifier circuit 12. The current voltage conversion circuit 14 detects the currents flowing through the differential pair of the differential amplifier circuit 12. The start bias circuit 15 causes a current to flow through the first diode D1 with the smaller junction area, based on the output from the current voltage conversion circuit 14. The start bias circuit 15 generates a start signal SC as an output. The start bias circuit 15 supplies the start signal SC to the differential amplifier circuit 12 and to the bandgap core circuit 11.

The replica circuit 13 forms a differential amplifier circuit. The replica circuit 13 includes the differential pair which is formed by a pair of n-channel transistors MN10 and MN11. The replica circuit 13 includes an n-channel transistor MN8. The replica circuit 13 includes a p-channel transistor MP9. The differential-paired n-channel transistors MN10 and MN11 have sources which are commonly connected through the n-channel transistor MN8 to the lower voltage VSS such as the ground potential VSS. The n-channel transistor MN11 has a drain that is connected to the power supply VDD. The n-channel transistor MN10 has a drain that is connected to a drain of the p-channel transistor MP9. The drain of the n-channel transistor MN10 is also connected to a gate of the p-channel transistor MP9. The p-channel transistor MP9 has a source that is connected to the power supply VDD. The n-channel transistor MN11 has a gate that is connected to the anode of the first diode D1 in the bandgap core circuit 11. The n-channel transistor MN10 has a gate that is connected to the connecting point between the resistance R3 and the p-channel transistor MP2 in the bandgap core circuit 11. The n-channel transistor MN8 has a source that is connected to the lower voltage VSS such as the ground potential VSS. The n-channel transistor MN8 has a gate that is connected to the gate of the n-channel transistor MN6 in the differential amplifier circuit 12.

The current voltage conversion circuit 14 may include, but is not limited to, a p-channel transistor MP8 and an n-channel transistor MN7. The p-channel transistor MP8 has a gate that is connected to the gate of the p-channel transistor MP9 in the replica circuit 13. The p-channel transistor MP8 has a source that is connected to the power supply VDD. The p-channel transistor MP8 has a drain that is connected through the n-channel transistor MN7 to the lower voltage VSS such as the ground potential VSS. The n-channel transistor MN7 is connected between the drain of the p-channel transistor MP8 and the lower voltage VSS such as the ground potential VSS. The n-channel transistor MN7 has a source that is connected to the lower voltage VSS such as the ground potential VSS. The n-channel transistor MN7 has a drain that is connected to the drain of the p-channel transistor MP8. The n-channel transistor MN7 has a gate that is connected to the gate of the n-channel transistor MN8 in the replica circuit 13.

The start bias circuit 15 may include, but is not limited to, a p-channel transistor MP7. The p-channel transistor MP7 has a source that is connected to the power supply VDD. The p-channel transistor MP7 has a gate that is connected to the drain of the p-channel transistor MP8 and the drain of the n-channel transistor MN7 in the current voltage conversion circuit 14. The p-channel transistor MP7 has a drain that is connected to the anode of the first diode D1 in the bandgap core circuit 11. The p-channel transistor MP7 supplies a drain current that serves as a start signal SC to the first diode D1 in the bandgap core circuit 11. The drain of the p-channel transistor MP7 is also connected to the gate of the n-channel transistor MN11 in the replica circuit 13.

The second bias circuit 17 may include, but is not limited to, an n-channel transistor MN9 and a resistance R5. The n-channel transistor MN9 has a source that is connected to the lower voltage VSS such as the ground potential VSS. The n-channel transistor MN9 has a drain that is connected through the resistance R5 to the power supply VDD. The n-channel transistor MN9 has a gate that is connected to the drain thereof. The gate of the n-channel transistor MN9 is connected to the gate of the n-channel transistor MN8 in the replica circuit 13. The gate of the n-channel transistor MN9 is connected to the gate of the n-channel transistor MN7 in the current voltage conversion circuit 14. The gate of the n-channel transistor MN9 is connected to the gate of the n-channel transistor MN6 in the differential amplifier circuit 12.

Figure 3:
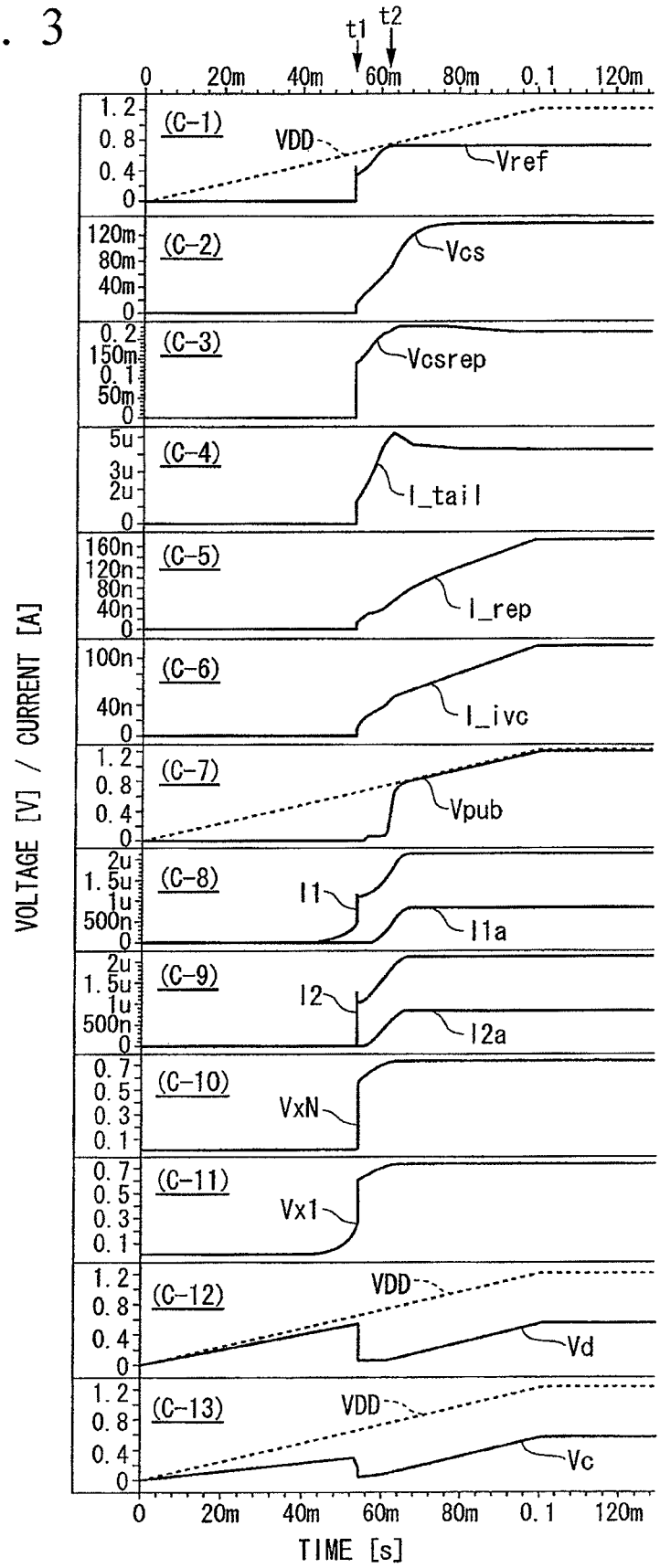
FIG. 3 is a diagram illustrating simulated voltage waveforms and simulated current waveforms of the bandgap reference circuit of FIG. 2 when the bandgap reference circuit is in the power up.

FIG. 3 is a diagram illustrating simulated voltage waveforms and simulated current waveforms of the bandgap reference circuit of FIG. 2 when the bandgap reference circuit is in the power up.

In the initial time period of the power up operation, the power supply VDD has the lower potential. All of the p-channel and n-channel transistors MN1, MN2, MN3, MN4, MN6, MN7, MN8, MN9, MN10, MN11, MP1, MP2, MP3, MP4, MP5, MP6, MP7, MP8, and MP9 are in OFF. When the potential of the power supply VDD is increased to exceed over the threshold voltage of the n-channel transistors MN1, MN2, MN3, MN4, MN6, MN7, MN8, MN9, MN10, MN11, then the n-channel transistor MN9 in the second bias circuit 17 turns ON. Since the n-channel transistors MN6, MN7 and MN8 have current mirrors to the n-channel transistor MN9, the n-channel transistors MN6, MN7 and MN8 turn ON. No current has been flown in the bandgap core circuit 11. In the differential amplifier circuit 12, the gate potential Vx1 of the n-channel transistor MN1 is almost 0V and also the gate potential VxN of the n-channel transistor MN2 is almost 0V.

As shown in FIG. 3 (C-1), the potential of the power supply VDD is risen from 0V to 1.2V in a time period of 100 ms. In the first time period of not later than 41.6 ms, the power supply VDD is not more than 0.5V. In the first time period, the gate potential Vx1 of the n-channel transistor MN1 is almost 0V as shown in FIG. 3(C-11) and the gate potential VxN of the n-channel transistor MN2 is almost 0V as shown in FIG. 3(C-10).

In the second time period from 41.6 ms to 50 ms, the power supply VDD is increased from 0.5V to 0.6V. The gate potential Vx1 of the n-channel transistor MN1 starts to rise as shown in FIG. 3(C-11), while the gate potential VxN of the n-channel transistor MN2 is kept at almost 0V as shown in FIG. 3(C-10). In the second time period, no currents flow in the replica circuit 13 and the current voltage conversion circuit 14, while the n-channel transistor MN8 in the replica circuit 13 has turned ON, and also the n-channel transistor MN7 in the current voltage conversion circuit 14 has turned ON. Thus, the output voltage Vpub of the current voltage conversion circuit 14 is almost 0V. The output voltage Vpub is applied to the gate of the p-channel transistor MP7 in the start bias circuit 15. In the start bias circuit 15, the p-channel transistor MP7 turns ON, so that the start bias circuit 15 supplies the start signal SC as an output current to the bandgap core circuit 11 and to the different amplifier circuit 12. The start signal SC as the output current is supplied to the resistance R1 in the bandgap core circuit 11, so that a current I1*b* flows through the resistance R1, and the voltage Vx1 of the first diode D1 with the smaller junction area is increased, while no current flows through the first diode D1.

In the third time period from 50 ms to a time "t1" near 52 ms, the drain current as the start signal SC of the p-channel transistor MP7 in the start bias circuit 15 is exponentially increased because the gate-drain voltage is near to the threshold voltage. Exponentially increasing the drain current as the start signal SC increases the voltage Vx1 of the first diode D1 with the smaller junction from 0.6V up to the same level as the potential of the power supply VDD as shown in FIG. 3(C-11). Pulling the voltage Vx1 up to the same level as the potential of the power supply VDD causes the n-channel transistor MN1 to turn ON, thereby starting to increase the source potential Vcs of the n-channel transistor MN1. As a result, the tail current "I_Tail" starts to flow in the differential amplifier circuit 12 as shown in FIG. 3 (C-4). The tail current "I_Tail" flows only through the n-channel transistor MN1. Thus, the drain voltage Vc of the p-channel transistor MP4 drops as shown in FIG. 3(C-13). The dropped drain voltage Vc of the p-channel transistor MP4 is supplied to the gates of the p-channel transistors MP1, MP2, and MP3 in the bandgap core circuit 11, thereby causing the p-channel transistors MP1, MP2, and MP3 to turn ON. Placing the p-channel transistors MP1, MP2, and MP3 in ON state increases the voltage VxN across the second diode D2 and the output voltage Vref as shown in FIG. 3(C-10) and FIG. 3(C-1). Increase of the voltage VxN causes the n-channel transistor MN2 to turn ON, thereby starting to apply a current to the p-channel transistor MP5. As a result, the drain voltage Vd of the p-channel transistor MP5 is dropped as shown in FIG. 3(C-12). The dropped drain voltage Vd is supplied to the gate of the p-channel transistor MP4, so that the p-channel transistor MP4 turns ON. At this time, however, the p-channel transistors MP4 and MP5 have not yet ensured the gate-source voltage that is high enough to apply a sufficient current. The drain voltages Vd and Vc of the p-channel transistors MP5 and MP4 have been still almost the same as the source potential Vcs of the n-channel transistor MN1, and thus the differential amplifier circuit 12 has been still inoperable.

In the fourth time period after the time "t1", the power voltage VDD is further increased. As shown in FIG. 3(C-8) and FIG. 3(C-9), currents I1*a* and I2*a* start to flow through the first and second diodes D1 and D2, respectively, in the bandgap core circuit 11. As a result, the gate voltages Vx1 and VxN of the n-channel transistors MN1 and MN2 are increased to approach predetermined values, respectively, as shown in FIG. 3(C-11) and FIG. 3(C-10). Increasing the gate voltages Vx1 and VxN increases the source voltage Vcs of the n-channel transistors MN1 and MN2 of the differential amplifier circuit 12 as shown in FIG. 3(C-2). Increasing the gate voltages Vx1 and VxN also increases the source voltage Vcsrep of the n-channel transistors MN10 and MN11 of the replica circuit 13 as shown in FIG. 3(C-3). Increasing the source voltage Vcs increases the tail current "I_tail" of the of the differential amplifier circuit 12 as shown in FIG. 3(C-4). Increasing the source voltage Vcsrep increases the drain current I_rep of the p-channel transistor MP9 in the replica circuit 13 as shown in FIG. 3(C-5). The drain current I_ivc of the p-channel transistor MP4 in the current voltage conversion circuit 14 is increasing as shown in FIG. 3(C-6).

In order to simplify the following descriptions, it is assumed that the n-channel transistors MN10 and MN11 have the same size, and that the p-channel transistors MP8 and MP9 have the same size, and the mirror ratio is 1. In the start bias circuit 15, the size of the n-channel transistor MN7 is adjusted so that the current ratio of the n-channel transistor MN7 to the p-channel transistors MP8 is about ½. The voltage Vx1 across the first diode D1 with the smaller junction area is pulled up by the p-channel transistor MP7 until the differential amplifier circuit 12 comes into the operable state. Thus, the voltage Vx1 is higher than the voltage VxN across the second diode D2 with the larger junction area as long as the voltage Vx1 is pulled up by the p-channel transistor MP7. A majority of the drain current I_rep of the p-channel transistor MP9 in the replica circuit 13 as shown in FIG. 3(C-5) flows to the n-channel transistor MN11. Increasing the power voltage VDD increases the tail current I_tail of the differential amplifier circuit 12, so that the differential amplifier circuit 12 comes into the operable state. Once the differential amplifier circuit 12 is placed in the operable state, the differential amplifier circuit 12 acts so that the voltages Vx1 and VxN approach to each other. As the voltages Vx1 and VxN become nearly equal to each other, the currents of the n-channel transistors MN10 and MN11 become nearly equal to each other. Since it is assumed that the mirror ratio of the p-channel transistor MP9 to the p-channel transistor MP8, the current I_ivc flowing in the current voltage conversion circuit 14 will approach ½ of the current Irep of the replica circuit 13. Since the size of the n-channel transistor MN7 is adjusted to approximately a half of the size of the n-channel transistor MN7, the gate potential Vpub of the p-channel transistor MP7 is transitioned from the low level to the high level as shown in FIG. 3(C-7). The transition of the gate potential Vpub of the p-channel transistor MP7 is caused at a time "t2" which is near 62 ms. After the time "t2", then the p-channel transistor MP7 is kept OFF, so that the bandgap core circuit 11 acts as the normal low voltage band gap reference circuit.

As described above, the time "t1" is a point at which the tail current I_tail starts to flow in the differential amplifier circuit 12. Before the time "t1", the tail current I_tail is kept zero. The time "t2" is a point at which the differential amplifier circuit 12 comes operable to have the voltages Vx1 and VxN equal to each other. The combination of the replica circuit 13 and the current voltage conversion circuit 14 detects, at the time "t2", that the differential amplifier circuit 12 comes operable, so as to cause that the p-channel transistor MP7 is transitioned from ON to OFF in the start bias circuit 15.

As described above, the transition of the p-channel transistor MP7 from ON-state to OFF-state has not been caused, until the start control circuit 20 has detected that the tail current I_tail has started to flow and the differential amplifier circuit 12 has come operable. The transition of the p-channel transistor MP7 from ON-state to OFF-state is caused, after the combination of the replica circuit 13 and the current voltage conversion circuit 14 has detected that the tail current I_tail has started to flow and the differential amplifier circuit 12 has started to operate. The p-channel transistor MP7 turns OFF after the combination of the replica circuit 13 and the current voltage conversion circuit 14 has detected that the differential amplifier circuit 12 has started to operate.

Namely, the start control circuit 20 continues supplying the start signal SC to the differential amplifier 2 and the bandgap core circuit 11, until the start control circuit 20 has detected that the tail current I_tail has started to flow and that the differential amplifier circuit 12 has come operable. The start control circuit 20 discontinues supplying the start signal SC to the differential amplifier circuit 12 and the bandgap core circuit 11, after the start control circuit 20 has detected that the tail current I_tail has started to flow and the differential amplifier circuit 12 has started to operate. The start control circuit 20 discontinues supplying the start signal SC to the bandgap core circuit 11, after the differential amplifier circuit 12 has started to operate.

The start control circuit 20 prevents that supplying the start signal SC to the bandgap core circuit 11 is discontinued without confirming that the differential amplifier circuit 12 has started to operate, thereby preventing that the bandgap core circuit 11 from not entering into the operation. The start control circuit 20 ensures stable operations of the bandgap core circuit 11.

Third Embodiment

Figure 4:
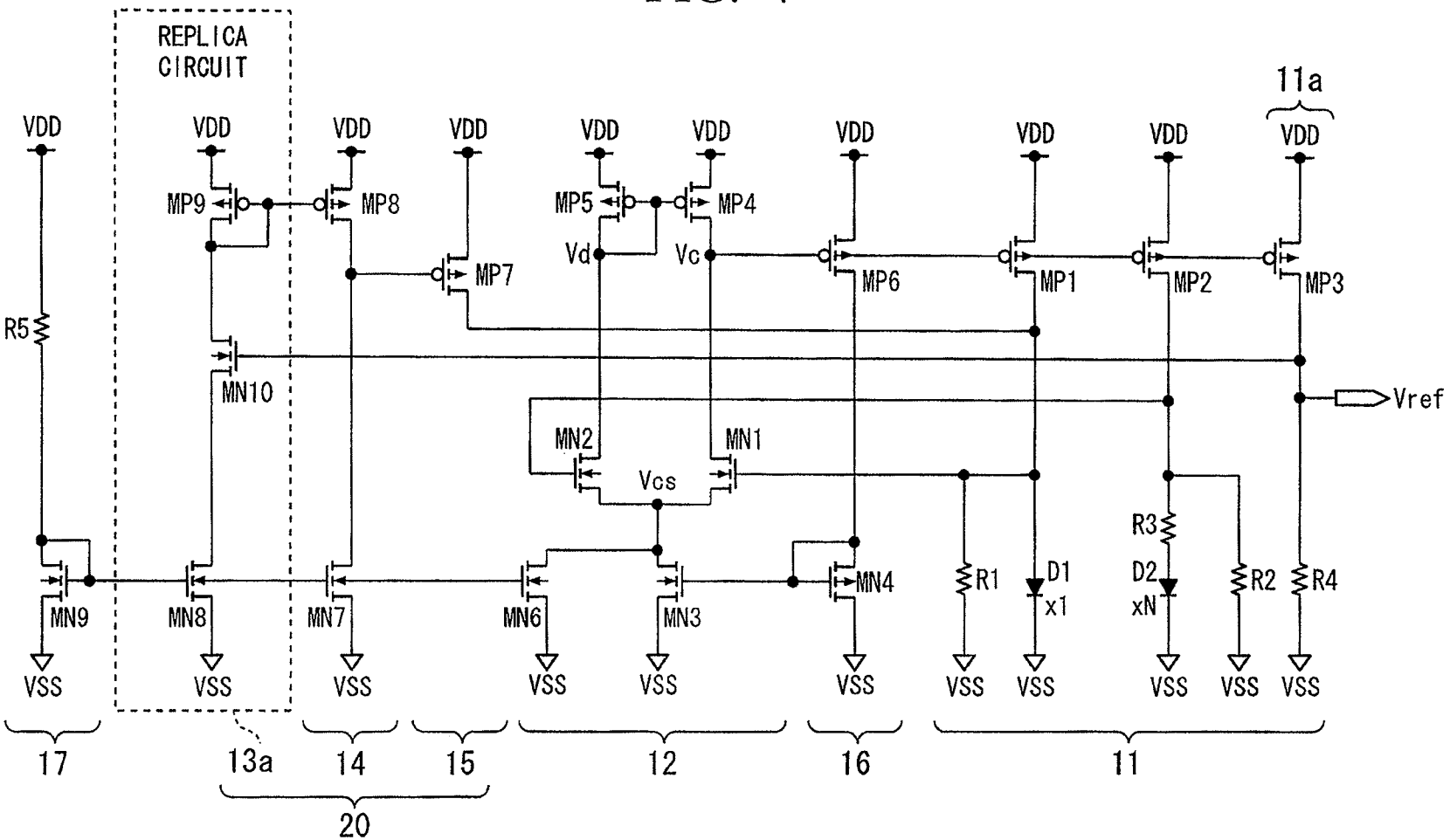
FIG. 4 is a circuit diagram illustrating a bandgap reference circuit in accordance with a third embodiment of the present invention.

FIG. 4 is a circuit diagram illustrating a bandgap reference circuit in accordance with a third embodiment of the present invention. A bandgap reference circuit of FIG. 4 is different from the bandgap reference circuit of FIG. 2 in the configuration of the replica circuit. The bandgap reference circuit of FIG. 4 has a replica circuit 13*a* which is different in configuration from the replica circuit 13 of the bandgap reference circuit of FIG. 2. The bandgap reference circuit of FIG. 4 may include, but is not limited to, the bandgap core circuit 11, the differential amplifier circuit 12, the start control circuit 20, the first bias circuit 16, and the second bias circuit 17. The start control circuit 20 may include, but is not limited to, a replica circuit 13*a*, the current voltage conversion circuit 14, and the start bias circuit 15. The start bias circuit 15 includes the p-channel transistor MP7 which generates the drain current which will serve as the start signal SC. The start signal SC as the output current is supplied to the differential amplifier circuit 12.

The replica circuit 13*a* of FIG. 4 is free of the n-channel transistor MN11 which is included in the replica circuit 13 of FIG. 2. The gate of the n-channel transistor MN10 is connected to the output terminal "To" of the bandgap reference circuit, but not connected to the positive input "IN(+)" of the differential amplifier circuit 12. The replica circuit 13*a* of FIG. 4 amplifies the output signal of the bandgap core circuit 11. This circuit configuration is designed to detect rising up of the output voltage Vref because detecting the rising up of the output voltage Vref will detect that the differential amplifier circuit 12 comes into the operational state. Thus, the bandgap reference circuit of FIG. 4 will provide the same effects as the effects of the bandgap reference circuit of FIG. 2.

Figure 5:
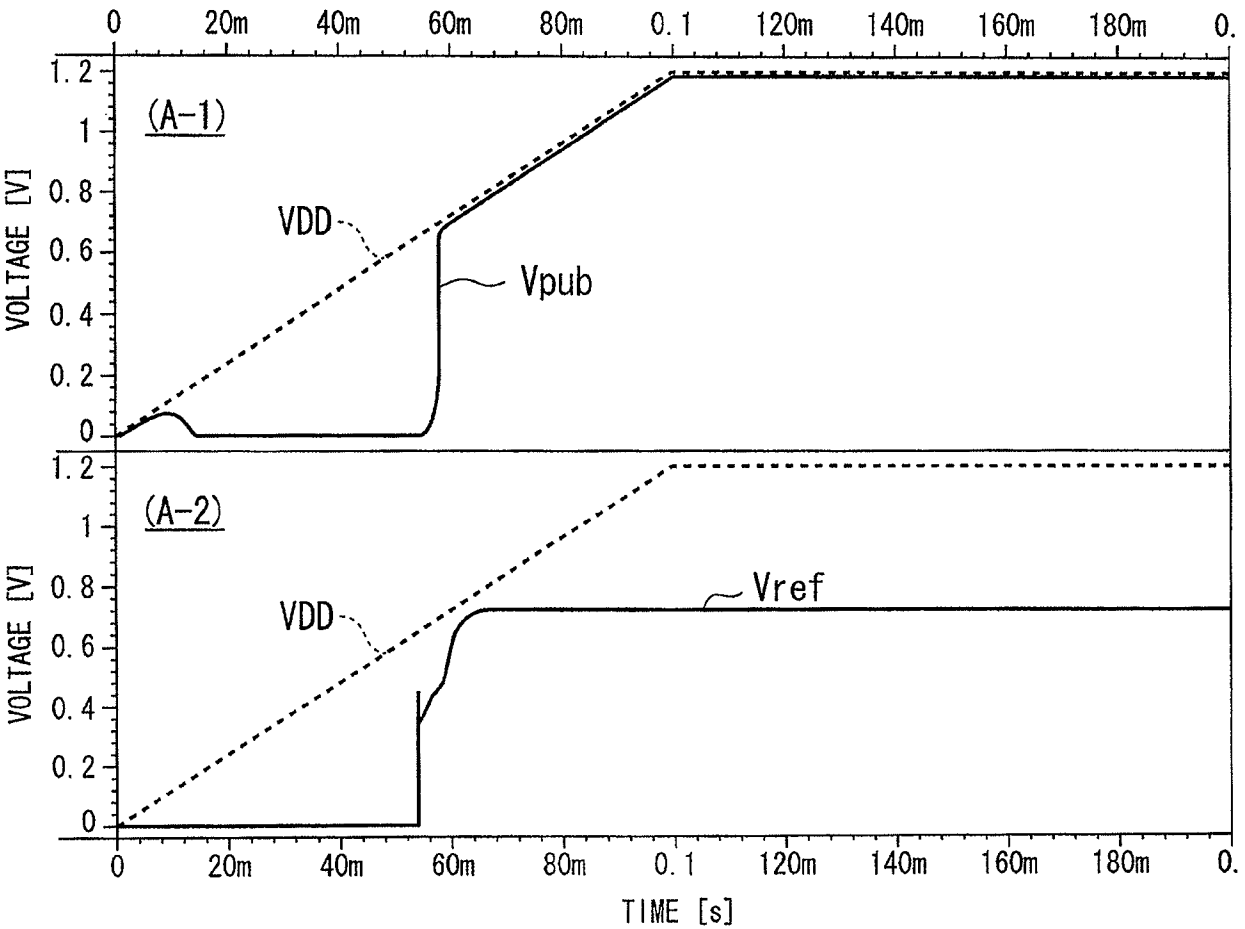
FIG. 5 is a diagram illustrating simulated voltage waveforms and simulated current waveforms of the bandgap reference circuit of FIG. 4 when the bandgap reference circuit is in the power up.

FIG. 5 is a diagram illustrating simulated voltage waveforms and simulated current waveforms of the bandgap reference circuit of FIG. 4 when the bandgap reference circuit is in the power up. The output voltage Vpub of the current voltage conversion circuit 14 is shown in FIG. 5(A-1). The output voltage Vpub is given by the gate voltage of the p-channel transistor MP7. The output voltage Vref of the bandgap reference circuit is shown in FIG. 5(A-2). In FIG. 5(A-1) and FIG. 5(A-2), the power voltage VDD is proportionally increased from 0 ms to 100 ms. The simulated waveforms of the output voltages Vpub and Vref show that the output voltages Vpub and Vref will stably be risen without any excessive rising.

The terms of degree such as "substantially," "about," and "approximately" as used herein mean a reasonable amount of deviation of the modified term such that the end result is not significantly changed. For example, these terms can be construed as including a deviation of at least ±5 percents of the modified term if this deviation would not negate the meaning of the word it modifies.

It is apparent that the present invention is not limited to the above embodiments, but may be modified and changed without departing from the scope and spirit of the invention.

What is claimed is:

1. The semiconductor device comprising:

a first transistor coupled between a first power supply line and a first node and including a control electrode coupled to a first common node;

a second transistor coupled between the first power supply line and a second node and including a control electrode coupled to the first common node;

a first diode coupled between the first node and a second power supply line;

a second diode and a first resistor coupled in series between the second node and the second power supply line;

a third transistor coupled between the first power supply line and a reference voltage output terminal and including a control electrode coupled to the first common node;

a differential amplifying circuit that includes an output terminal coupled to the first common node, a first input terminal coupled to the first node, and a second input terminal coupled to the second node;

a control circuit including an output node coupled to the first node and including an input node coupled to the reference voltage output terminal or the second node;

wherein the control circuit includes a fourth transistor coupled between the first node and the first power supply line, the fourth transistor including a control electrode coupled to a third node, a fifth transistor coupled between the third node and the first power supply line, a sixth transistor coupled between the first power supply line and a fourth node and including a control electrode coupled to a control electrode of the fifth transistor and the fourth node, and a seventh transistor coupled between the fourth node and a fifth node and including a control electrode coupled to the reference voltage output terminal or the second node.

2. The semiconductor device according to claim 1, wherein the control circuit includes an eighth transistor coupled between the first power line and the fifth node, the eighth transistor including a control electrode coupled to the first node.

3. The semiconductor device according to claim 1, wherein the differential amplifying circuit including a fourth transistor coupled between the first power supply line and the first common node, a fifth transistor coupled between the first power line and a control electrode of the fourth transistor and including a control electrode coupled to the control electrode of the fourth transistor, a sixth transistor coupled to the first common node and a second common node and including a control electrode coupled to the first node, and a seventh transistor coupled between the control electrode of the fourth transistor and the second common node and including a control electrode coupled to the second node.

4. The semiconductor device according to claim 1, wherein the first and second transistors, the first and second diodes, and the first resistor configure a part of a bandgap circuit.

5. The semiconductor device comprising:

a first transistor coupled between a first power supply line and a first node and including a control electrode coupled to a first common node;

a second transistor coupled between the first power supply line and a second node and including a control electrode coupled to the first common node;

a first diode coupled between the first node and a second power supply line;

a second diode and a first resistor coupled in series between the second node and the second power supply line;

a third transistor coupled between the first power supply line and a reference voltage output terminal and including a control electrode coupled to the first common node;

a differential amplifying circuit that includes an output terminal coupled to the first common node, a first input terminal coupled to the first node, and a second input terminal coupled to the second node; and a control circuit including an output node coupled to the first node and including an input node coupled to the reference voltage output terminal;

wherein the control circuit includes a fourth transistor coupled to the first power supply line and a third node and the fourth transistor including a control electrode coupled to the third node, a fifth transistor coupled to the third node and including a control electrode coupled to the reference voltage output terminal, a sixth transistor coupled to the first power supply line and a fourth node and including a control electrode coupled to the third node, and a seventh transistor coupled between the first power supply line and the first node and including a control electrode coupled to the fourth node.

6. The semiconductor device according to claim 5, wherein the first and second transistors, the first and second diode, and the first resistor configure a part of a bandgap circuit.

7. A semiconductor device comprising:

a first transistor coupled between a first power supply line and a first node and including a control electrode coupled to a first common node;

a second transistor coupled between the first power supply line and a second node and including a control electrode coupled to the first common node;

a first diode coupled between the first node and a second power supply line;

a second diode and a first resistor coupled in series between the second node and the second power supply line;

a first differential amplifying circuit that includes an output terminal coupled to the first common node, a first input terminal coupled to the first node, and a second input terminal coupled to the second node;

a control circuit including an output node coupled to the first node and including an input node coupled to the second node;

wherein the control circuit includes a second differential circuit including a first input node coupled to the first node and a second input node coupled to the second node, wherein the control circuit includes a third transistor coupled between the first power supply line and the first node.

8. The semiconductor device according to claim 7, wherein the second differential circuit includes an output node indirectly connected to the control electrode of the third transistor.

9. The semiconductor device according to claim 7, wherein the second differential circuit includes an output node coupled to the control electrode of the third transistor.

10. A semiconductor device comprising:

a first transistor coupled between a first power supply line and a first node and including a control electrode coupled to a first common node;

a second transistor coupled between the first power supply line and a second node and including a control electrode coupled to the first common node;

a first diode coupled between the first node and a second power supply line;

a second diode and a first resistor coupled in series between the second node and the second power supply line;

a first differential amplifying circuit that includes an output terminal coupled to the first common node, a first input terminal coupled to the first node, and a second input terminal coupled to the second node;

a control circuit including an output node coupled to the first node and including an input node coupled to the second node;

wherein the control circuit includes a second differential circuit including a first input node coupled to the first node and a second input node coupled to the second node, wherein the second differential circuit includes an output node indirectly connected to the control electrode of the third transistor.

11. A semiconductor device comprising:

a first transistor coupled between a first power supply line and a first node and including a control electrode coupled to a first common node;

a second transistor coupled between the first power supply line and a second node and including a control electrode coupled to the first common node;

a first diode coupled between the first node and a second power supply line;

a second diode and a first resistor coupled in series between the second node and the second power supply line;

a first differential amplifying circuit that includes an output terminal coupled to the first common node, a first input terminal coupled to the first node, and a second input terminal coupled to the second node;

a control circuit including an output node coupled to the first node and including an input node coupled to the second node;

wherein the control circuit includes a second differential circuit including a first input node coupled to the first node and a second input node coupled to the second node, wherein the control circuit includes a third transistor coupled between the first power supply line and the first node and the third transistor including a control electrode coupled to a third node, a fourth transistor coupled between the third node and the first power supply line, a fifth transistor coupled between the first power supply line and a fourth node and including a control electrode coupled to a control electrode of the fourth transistor and the fourth node, and a sixth transistor coupled between the fourth node and a fifth node and including a control electrode coupled to the second node.

12. The semiconductor device according to claim 11, wherein the control circuit includes an eighth transistor coupled between the first power line and the fifth node and including a control electrode coupled to the first node.

* * * * *